US007958661B2

(12) United States Patent
Strayer

(10) Patent No.: US 7,958,661 B2
(45) Date of Patent: Jun. 14, 2011

(54) FIREARM HAVING UNIVERSAL MAGAZINE RELEASE MECHANISM

(76) Inventor: Sandy L. Strayer, North Richland Hills, TX (US)

( * ) Notice: Subject to any disclaimer, the term of this patent is extended or adjusted under 35 U.S.C. 154(b) by 167 days.

(21) Appl. No.: 12/386,330

(22) Filed: Apr. 16, 2009

(65) Prior Publication Data

US 2010/0263252 A1 Oct. 21, 2010

(51) Int. Cl.
*F41A 9/61* (2006.01)

(52) U.S. Cl. ..... 42/50; 42/7; 42/49.01

(58) Field of Classification Search ..... 42/7, 49.01, 42/49.02, 50, 49.1, 70.02
See application file for complete search history.

(56) References Cited

U.S. PATENT DOCUMENTS

| | | | | | |
|---|---|---|---|---|---|
| 3,715,826 | A * | 2/1973 | Seifried | 42/70.06 |
| 4,236,337 | A * | 12/1980 | Beretta | 42/7 |
| 4,326,353 | A * | 4/1982 | Ludwig et al. | 42/7 |
| 4,449,311 | A * | 5/1984 | Giragosian | 42/7 |
| 4,521,985 | A * | 6/1985 | Smith et al. | 42/7 |
| 4,539,770 | A * | 9/1985 | Bornancini | 42/7 |
| 4,573,280 | A * | 3/1986 | Malhotra | 42/7 |
| 4,574,509 | A * | 3/1986 | Smith | 42/7 |
| 4,599,818 | A * | 7/1986 | Fedora et al. | 42/7 |
| 4,638,581 | A * | 1/1987 | Moore | 42/7 |
| 4,713,902 | A * | 12/1987 | Wigton | 42/7 |
| 4,759,144 | A * | 7/1988 | Egan et al. | 42/7 |
| 4,768,301 | A * | 9/1988 | Thomas | 42/7 |
| 4,798,018 | A * | 1/1989 | Johansson | 42/7 |
| 4,835,892 | A * | 6/1989 | Ruger et al. | 42/7 |
| 4,899,476 | A * | 2/1990 | Hindle | 42/7 |
| 4,949,492 | A * | 8/1990 | Clifton, Jr. | 42/7 |
| 5,050,480 | A * | 9/1991 | Knight et al. | 89/147 |
| 5,058,301 | A * | 10/1991 | Lishness et al. | 42/7 |
| 5,520,019 | A * | 5/1996 | Schuetz | 42/49.02 |
| 5,628,134 | A * | 5/1997 | Wesp et al. | 42/7 |
| 7,219,462 | B2 * | 5/2007 | Finn | 42/49.01 |
| 7,559,166 | B2 * | 7/2009 | Bubits | 42/7 |
| 7,562,482 | B1 * | 7/2009 | Johnson | 42/90 |
| 7,596,900 | B2 * | 10/2009 | Robinson et al. | 42/7 |
| 7,661,219 | B1 * | 2/2010 | Knight et al. | 42/70.02 |
| 2010/0281736 | A1 * | 11/2010 | Mayberry et al. | 42/49.01 |

* cited by examiner

*Primary Examiner* — Bret Hayes
*Assistant Examiner* — Michael D David
(74) *Attorney, Agent, or Firm* — James L. Jackson

(57) ABSTRACT

A universal magazine release mechanism for firearms has a frame defining a cartridge magazine chamber receiving a cartridge magazine and having a magazine release receptacle intersecting the cartridge magazine chamber. A magazine release member is mounted within the magazine release receptacle and has linear movement to a magazine retaining position and a magazine release position. A spring urges the magazine release member toward the magazine retaining position. A magazine release button extends from the magazine release member and is exposed externally of the firearm frame for engagement and linear movement by the thumb of a user's hand. The magazine release member is selectively positioned to locate the magazine release button for thumb actuation by a right-handed user or a left-handed user.

8 Claims, 3 Drawing Sheets

FIREARM HAVING UNIVERSAL MAGAZINE RELEASE MECHANISM

BACKGROUND OF THE INVENTION

1. Field of the Invention

The present invention relates generally to firearms, particularly autoloading handguns, and more specifically concerns a reversible magazine release mechanism for handguns. Even more specifically, the present invention is a universal magazine release mechanism that can be selectively assembled with a firearm to adapt the firearm for efficient and comfortable use by right handed users or left-handed users. While this invention is described herein particularly as it relates to autoloading handguns, it is intended that the invention be readily adaptable for a wide range of firearms, including shoulder fired rifles, shotguns, and the like and firearms that employ a number of different types of projectiles.

2. Description of the Prior Art

The 1911 A1 semi-automatic, autoloading handgun, initially developed for military use by personnel of the United States, is representative of the type of handgun to which the present invention is particularly concerned. The 1911 A1 handgun is still in use at the present time and a number of different types of handguns have been developed by a number of different manufacturers which employ a cartridge autoloading feature that is generally along the lines of the original 1911 A1 handgun. In simple terms the 1911 A1 handgun employs a frame supporting a barrel and having a spring biased reciprocating slide member that is moved rearwardly, toward the user of the firearm, by the recoil force that is generated by gas pressure developed by the burning gunpowder of a round or cartridge being fired. This gas pressure is also the motive force that propels the bullet of a cartridge through the barrel and to a target on which the sights of the handgun are aligned.

As the slide member is moved rearwardly against the bias of its return spring, a cartridge case extractor in assembly with the slide extracts the spent cartridge case from the firing chamber of the barrel and moves it rearwardly until it contacts an ejector and is then projected outwardly through a cartridge ejection port of the slide member, away from the firearm and away from the user. The handgrip or handle that is a component of the handgun frame defines a magazine chamber, within which is positioned a magazine containing a number of cartridges. When the magazine is inserted to its full extent within the magazine receptacle it becomes locked or retained in place by a magazine release device that is moveably supported by the handgun frame. The magazine positions its first or uppermost of the cartridges in position to be removed from the magazine and transported into the firing chamber of the barrel by the forwardly or returning movement of the slide member. After a cartridge has been fired and its spent cartridge case extracted and ejected, the return spring moves the slide member forward, causing it to engage the exposed cartridge of the magazine and move it forward, into the firing chamber of the barrel. This cartridge handling and firing process occurs each time the trigger mechanism of the handgun is actuated by the user, until such time as the last of the cartridges of the handgun has been fired and its spent cartridge case has been extracted and ejected.

At this point the handgun is "empty" of cartridges. If additional firing is intended, the user will replace the empty cartridge magazine with a magazine containing cartridges or will remove the magazine and re-fill it with cartridges. Removal of the magazine of a 1911 A1 handgun or a firearm similar to the 1911 A1 is accomplished by pressing a magazine release button projecting from the left side of the frame, causing the magazine to be released from its locked position within the magazine receptacle.

The 1911 A1 autoloading handgun was primarily developed for use by right-handed users, since a majority of handgun users are right-handed. The magazine release button of the 1911 A1 firearm is located on the left side of the frame so that it is easily contacted and actuated by the thumb of the right hand of a user without necessitating release of the handgrip by a right-handed user. Unfortunately, if the user is left-handed, the user must reach to the left side of the handgun either over the slide member or under the forward part of the frame with the right hand to actuate the magazine release button. Alternatively the user may choose to change hands with the handgun so as to be able to actuate the magazine release button with the thumb of the right hand. This of course is an awkward activity that requires additional gun handling steps by a left-handed user and detracts from the speed and efficiency of handgun use. Such left-handed handling of a handgun is particularly disadvantageous if the user is involved in rapid fire shooting, such as during tactical shooting activity or during a rapid-fire match where the speed of gun handling activity is of the essence. It is therefore desirable to provide these types of handguns with magazine release mechanisms that can be selectively adapted for efficient use by left-handed users as well as right-handed users.

1911 A1 type handguns have been developed specifically for left-handed users, with the magazine release buttons of the magazine release mechanism located on the right side of the frame of the handgun, so as to be positioned for engagement and manual actuation by the thumb of the user's left hand. However, this is disadvantageous for the reason that additional inventory is required to accommodate the needs of right-handed and left-handed users. Moreover, a handgun that is specifically designed with a magazine release button on the right side of the handgun for a left-handed user cannot be efficiently used by a right-handed user. To date, to the knowledge of the inventor, handguns have not been developed for universal use with magazine release systems that permit selective assembly of a magazine release mechanism to a handgun frame so that it can be installed with one orientation for right-handed users and another orientation for left-handed users. Accordingly, the present invention has been designed for universal, selective assembly of a magazine release mechanism to a handgun frame mechanism to adapt the firearm for efficient use by right-handed users and left-handed users.

SUMMARY OF THE INVENTION

It is a principal feature of the present invention to provide a novel universal cartridge magazine release mechanism for handguns and other firearms that enables such handguns and other firearms to be quickly and efficiently converted for use by right-handed or left-handed users.

It is another feature of the present invention to provide a novel universal cartridge magazine release mechanism for handguns and other firearms, wherein the magazine release mechanism incorporates a magazine release shaft that is moveable linearly within a shaft receptacle and is secured against rotation within the receptacle.

Briefly, the various objects and features of the present invention are realized through the provision of a handgun or other firearm frame that defines an internal cartridge magazine chamber within which is releasably retained a magazine normally containing a number of cartridges. A linearly moveable magazine release shaft is retained for linear movement within a magazine release receptacle and has a magazine retaining condition and a magazine release condition. The magazine release shaft and the magazine release receptacle are of universal nature in that the shaft is quickly and efficiently removable from the receptacle and its position can be reversed to thus permit a person to prepare the firearm for efficient use by either right-handed or left-handed users.

A magazine release button is removably secured to an end of the magazine release shaft and, when removed from the shaft, permits the shaft to be removed from the shaft receptacle, reversed and installed from the opposite end of the shaft receptacle. The shaft receptacle and the shaft are each designed to permit linear shaft movement but prevent shaft rotation within the shaft receptacle. The magazine release mechanism is designed to permit simple and efficient change of a firearm such as an autoloading handgun to adapt it for right-handed or left-handed use through the use of simple readily available tools.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a side elevational view of a 1911 A1 type autoloading handgun having a conventional magazine release mechanism showing its magazine release button located on the left side of the frame, for efficient actuation by the thumb of the right hand of a right-handed user;

FIG. 2 is a fragmentary sectional view of a portion of the handgun frame, showing positioning of the magazine release button on the right side of the frame, particularly adapting the handgun for efficient actuation by the thumb of the left hand use by left-handed users;

FIG. 3 is a fragmentary elevational view taken along line 3-3 of FIG. 2 and showing positioning of the magazine release button on the left side of the handgun frame, particularly adapting the handgun for efficient actuation by the thumb of the right hand of right-handed users;

FIG. 4 is an exploded elevational view showing the components of the magazine release mechanism shown particularly in FIGS. 2 and 3;

FIG. 5 is a fragmentary sectional view through the handgrip portion of the handgun frame in plan, taken along line 5-5 of FIG. 3 and showing the installed condition of the magazine release mechanism being set up for a left-handed user; and FIG. 6 is a fragmentary sectional view similar to FIG. 5 showing the installed condition of the magazine release mechanism for a right-handed user;

DETAILED DESCRIPTION OF PREFERRED EMBODIMENT

It is to be understood that the terms "firearm", "handgun", "pistol" are intended to mean virtually any type of firearm, including handguns, rifles, shotguns and other mechanisms for firing projectiles and having an autoloading feature employing the pressure energized force of cartridge firing for ejecting spent cartridge cases and moving serially oriented cartridges from a replaceable cartridge magazine into the firing chamber of a barrel. Thus, while the present invention is discussed herein particularly as it relates to handguns, particularly 1911 A1 autoloading handguns, it is not intended to limit the spirit and scope of the present invention solely to this type of firearm. The present invention may have effective application with many other types of firearms having a magazine locking and release mechanism permitting the user of the firearm to manipulate a magazine release mechanism to release a cartridge magazine from its locked or retained position so that it can be easily replaced with a magazine containing cartridges or can be reloaded with cartridges and inserted into the magazine receptacle of the firearm.

Figure 1:
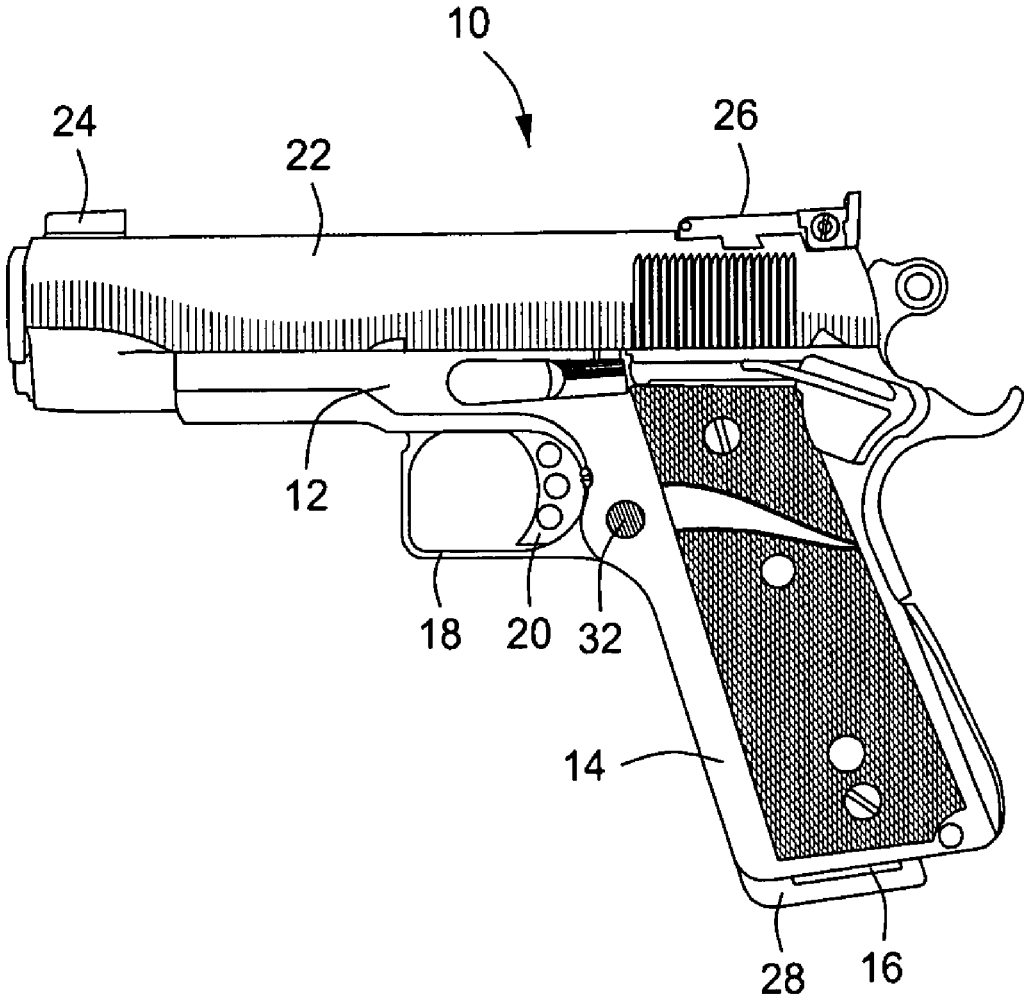
FIG. 1 (PRIOR ART)

Referring now to the drawings and first to FIG. 1, a 1911 A1 type of autoloading handgun is shown generally at 10 and represents the prior art. The handgun 10 incorporates a frame assembly 12 defining a handgrip 14, with the handgrip defining a cartridge magazine chamber 16. A trigger guard 18 is typically fixed to or an integral component of the frame assembly and provides protection for a trigger 20 that is in movable assembly with the frame components. To the frame assembly 12 is mounted a spring biased reciprocating slide member 22 to which front and rear sights 24 and 26 are mounted, permitting a user to aim the handgun at a target. A cartridge containing magazine 28 is inserted into the cartridge magazine chamber 16 and is latched, locked or frictionally retained within the cartridge magazine chamber by a magazine latch or lock mechanism having a magazine release button 32. To remove the magazine from the magazine receptacle the magazine release button is typically pressed by the thumb of a right-handed user, which moves the magazine latch mechanism and releases the magazine. Typically the weight of the magazine, even when empty of cartridges, will cause the magazine to fall out of the magazine receptacle of a handgun when the magazine receptacle is facing downwardly.

As mentioned above, when the handgun of FIG. 1 is being operated by a left-handed user, the magazine button, being on the left side of the handgun frame 12 near the trigger guard 18, cannot be actuated by the thumb of the left hand. The left-handed user can move the index finger to an awkward position to actuate the magazine release button, but this awkward movement compromises the stability of handgun support by the left hand of the user. Alternatively, the left-handed user can reach over or under the handgun mechanism to engage the magazine release button with a finger of the right hand. This is also an awkward hand movement of the right hand and also requires movement of the index finger of the left hand to an out of the way position for button actuation by a finger of the right hand. It is desirable, therefore, to provide a universal magazine locking and release mechanism that is readily adaptable for handguns and other firearms and which prepares the handgun or firearm for efficient use by right-handed and left-handed users.

Figure 2:
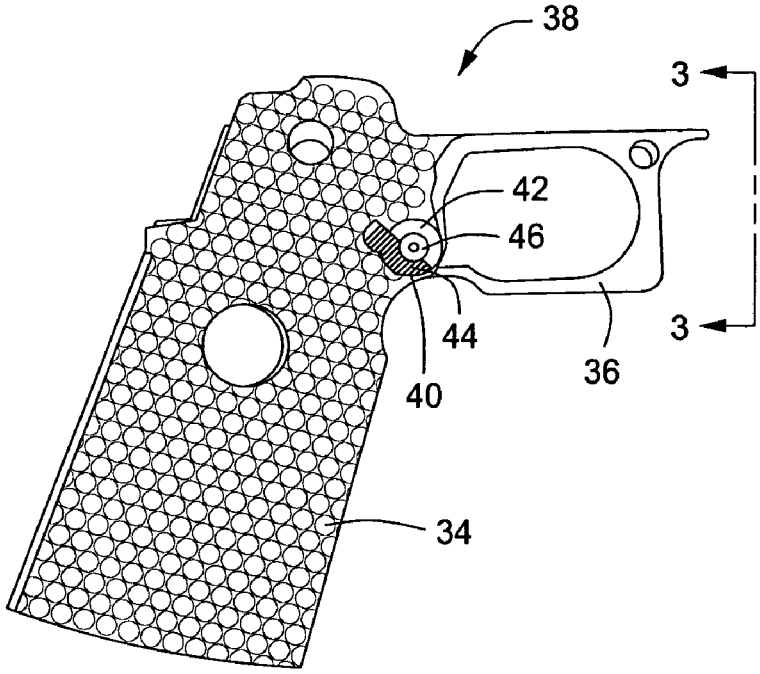
Figure 3:
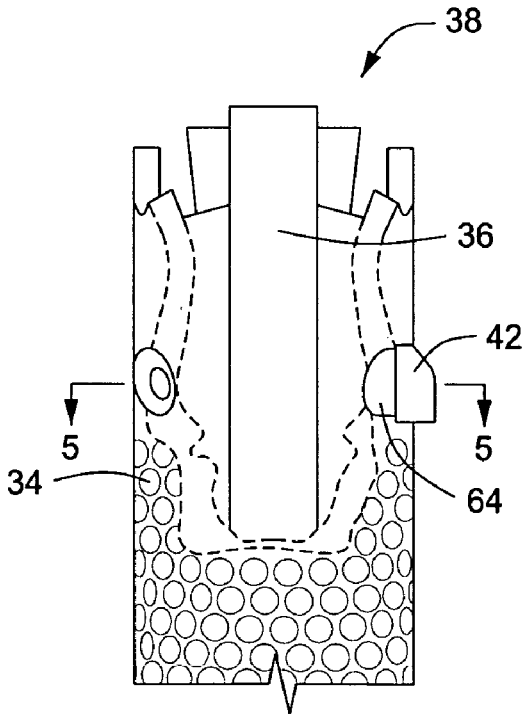
Figure 4:
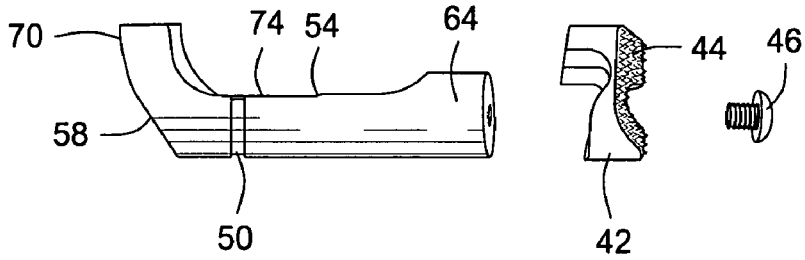

With reference to FIG. 2, there is shown the handgrip 34 and trigger guard 36 portions of a handgun frame assembly shown generally at 38. The frame assembly 38 is generally constructed along the lines of a 1911 A1 handgun. Thus, the frame assembly is designed for a handgun mechanism incorporating a reciprocating slide member that is moved rearwardly and extracts and ejects cartridge cases in response to the gas pressure of cartridge firing and is moved forwardly by spring force and picks up a cartridge from the magazine and transports it into the firing chamber of the barrel in readiness for subsequent firing.

The handgun frame assembly 38 is machined to define a magazine release receptacle 40 within which is moveably received a magazine release mechanism 42 having a removable magazine release button 44 that is positioned for actuating engagement by the thumb of the left hand of a left-handed user of the firearm. The magazine release button 44 is releasably secured to the magazine release mechanism 42 by a retainer screw 46. The magazine release mechanism 42 comprises a magazine release shaft 48 that is movably received within the magazine release receptacle 40 so as to be movable linearly by a manual force that is provided by the thumb of the user.

The magazine release shaft 48 defines a spring recess 50 within which is positioned a shaft return spring member 52. A portion of the shaft return spring member 52 is also received within a spring receptacle 54 that is defined within the handgun frame assembly 38. To release a cartridge magazine from the magazine chamber 16 the user will apply thumb pressure to the magazine release button 44 against the force of the return spring member 52, moving the magazine release shaft 48 to its magazine release position. After the cartridge magazine has been removed from the magazine chamber, thumb pressure is then released, permitting the return spring member 52 to return the magazine release shaft 48 to its original, magazine retaining position. At the magazine release position of the magazine release shaft 48 a stop projection 54 of the magazine release shaft 48 will be in shaft stopping contact with an internal surface of the handgun frame structure and serves to limit further linear shaft release movement within magazine release receptacle 40.

At the magazine retaining position a stop shoulder 56 of a shaft head member 58 is disposed in shaft positioning contact with a stop surface 60 that is defined by one of the substantially identical shaft head receiving pockets 62*a* and 62*b* of the handgun frame structure. The pockets 62*a* and 62*b* form outer portions of the magazine release receptacle 40 and permit the position of the magazine release shaft 48 to be selectively reversed within the magazine release receptacle. This feature permits the handgun to be readily adapted for efficient use by either right-handed or left-handed users simply by permitting a user to select the orientation of the magazine release shaft so that the magazine release button is located on the right side of the frame or the left side of the frame as suits the needs of the user. Moreover, the orientation of the magazine release shaft can be simply and efficiently reversed in a few minutes time so that a right-handed user and a left-handed user can both make efficient use of the handgun.

An end 64 of the magazine release shaft 48, opposite the shaft head member 58, defines a threaded opening 66. The magazine release button 44 defines an internal pocket 68 receiving the end 64 of the magazine release shaft 48 in close fitting relation therein. The retainer screw 46 extends through a screw opening of the magazine release button 44 and is threaded into the threaded opening 66 of the shaft end 64, thus securing the magazine release button in immovable but removable relation with the magazine release shaft. The magazine release button can be removed from the shaft end simply by removing the retainer screw 46.

Figure 5:
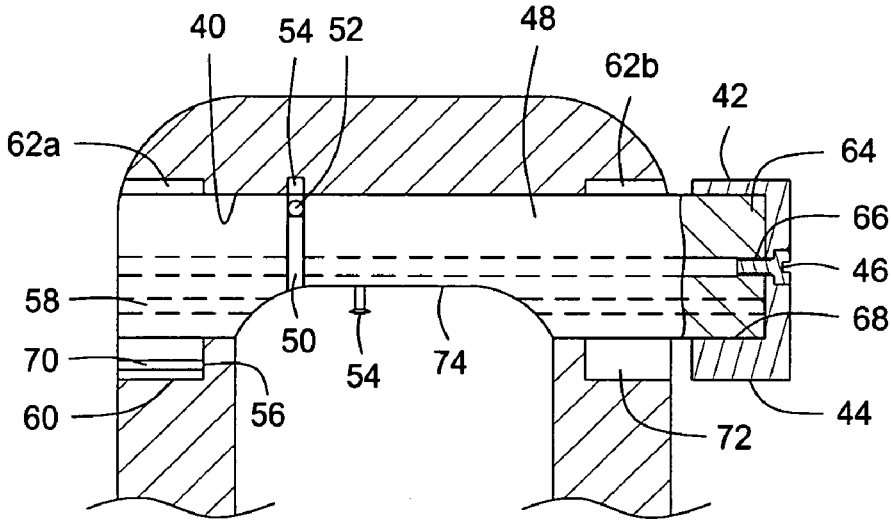
Figure 6:
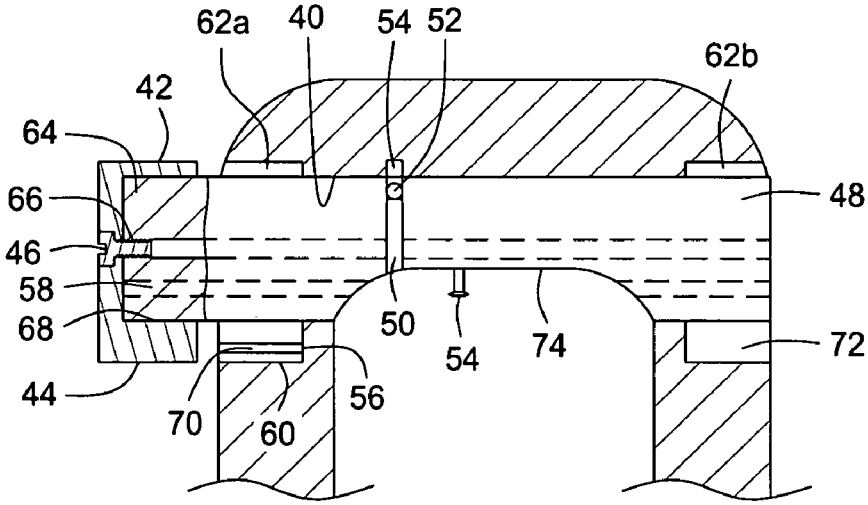

While FIG. 5 shows the universal magazine release mechanism 42 set up for handgun use by a left-handed user, the similar fragmentary sectional view of FIG. 6 shows the universal magazine release mechanism set up for handgun use by a right-handed user. This change is achieved by removing the retainer screw 46, permitting removal of the magazine release button 44 from the shaft 48. The magazine release shaft 48 is then removed from the receptacle 40 and is inserted into the opposite end of the receptacle.

The shaft return spring member is also re-arranged to provide a force urging the shaft head member 58 toward the shaft head receiving pocket 62*b*. After this has been done, the magazine release button 44 is then secured to the shaft end 64 by the retainer screw 46. Due to the simplicity of design, the magazine release mechanism can be changed to either of its universal position in only a few minutes time, with the change being accomplished through the use of a minimum of simple tools, such as an Allen wrench, screw-driver and any other simple and readily available tools that are typically used for handgun assembly and disassembly.

It is desirable to provide for linear magazine releasing and securing movement of the magazine release shaft within the magazine release receptacle 40 and it is also desirable to minimize or prevent free rotational movement of the magazine release shaft within the receptacle 40 to ensure efficiency of shaft return spring activity. When the magazine release shaft 40 is at its normal spring energized magazine retaining position a shaft positioning lobe 70 of the shaft head member 58 engages within a similarly oriented shaft lobe receptacle 72 which is located eccentrically with respect to the magazine release receptacle 40. In this position the magazine release shaft 48 is prevented from rotating.

Intermediate its ends the magazine release shaft 48 defines a substantially flat surface region 74 that is oriented in substantially co-planar relation with an internal substantially flat surface region within the cartridge magazine chamber 16. Opposite end portions of the flat surface region 74 are defined by curved surfaces 76 and 78 that also correspond with the internal surface configuration of the cartridge magazine chamber 16. Thus, the magazine release shaft 48 defines surfaces corresponding and being substantially coextensive with internal surfaces of the magazine chamber of the firearm.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A firearm having a universal cartridge magazine release mechanism, comprising:

a firearm frame defining a cartridge magazine chamber releasably receiving a cartridge magazine and having a magazine release receptacle intersecting said cartridge magazine chamber;

a magazine release member being disposed within said magazine release receptacle and having linear movement to a magazine retaining position and a magazine release position;

a spring member urging said magazine release member toward said magazine retaining position;

a magazine release button extending from said magazine release member and being exposed externally of the firearm frame for engagement and linear movement by the thumb of a user's hand;

said magazine release member being selectively positioned relative to said magazine release receptacle to locate said magazine release button at a first right-handed user location relative to said firearm frame to permit magazine release button actuation by the thumb of the right hand of a right-handed person and a second left-handed user location relative to the firearm frame to permit magazine release button actuation by the thumb of the left hand of a left-handed person;

said magazine release receptacle being defined by a magazine release passage extending through said firearm frame and having substantially cylindrical passage sections and being in communication with said cartridge magazine chamber, said passage sections being defined in part by external non-circular outwardly facing receptacles;

said magazine release member having an intermediate portion movably received by said substantially cylindrical passage sections and having a non-circular head at a first end thereof being selective disposed within a selected one of said external non-circular outwardly facing receptacles;

said magazine release member having a magazine release button removably mounted to a second end thereof and being exposed externally of said firearm frame for magazine releasing engagement by the thumb of the user's hand;

said magazine release member being selectively reversible within said magazine release passage, positioning said magazine release button on a selected side of said firearm frame and adapting said firearm for selective use by right-handed users or left-handed users;

said magazine release member defining a substantially cylindrical end;

said magazine release button having a substantially cylindrical pocket receiving said substantially cylindrical end of said magazine release member therein; and a retainer member securing said magazine release button in removable relation with said magazine release member.

2. The firearm of claim 1, comprising:

said magazine release member being substantially non-rotatable within said magazine release receptacle.

3. The firearm of claim 1, comprising:

said magazine release member being linearly moveable within said magazine release passage and being selectively oriented within said magazine release passage for location of said magazine release button on a first side of said firearm frame for thumb actuation by a right-handed user and on a second side of said firearm frame for thumb actuation by a left-handed user.

4. The firearm of claim 1, comprising:

said magazine release member having a non-circular end member being selectively receivable within one of said non-circular receptacles.

5. The firearm of claim 1, comprising:

said magazine release receptacle having substantially cylindrical sections each intersecting said cartridge magazine chamber;

said magazine release member being an elongate shaft having substantially cylindrical portions movable within said substantially cylindrical sections and having an intermediate portion exposed within said magazine release receptacle; and a magazine release member projecting from said intermediate portion of said magazine release member and releasing a cartridge magazine from said cartridge magazine chamber upon thumb actuated movement of said magazine release member by a firearm user.

6. The firearm of claim 5, comprising:

said firearm frame defining a left side and a right side when being held and aimed by a user;

said magazine release member being selectively inserted into said magazine release receptacle from said right side toward said left side for use by a left-handed user or from said left side toward said right side for use by a right-handed user; and a magazine release button removably mounted to an end of said magazine release member and being removed from said end to permit insertion of said magazine release member into said magazine release receptacle.

7. A firearm having a universal cartridge magazine release mechanism, comprising:

a firearm frame defining a cartridge magazine chamber releasably receiving a cartridge magazine and having a magazine release receptacle intersecting said cartridge magazine chamber, said firearm frame defining a right side and a left side when visualized by a user aiming said firearm at a target;

a magazine release member being positioned for movement within said magazine release receptacle and being movable to a magazine retaining position and a magazine release position;

a magazine release button extending from said magazine release member and being exposed externally of the firearm frame for engagement and linear movement by the thumb of a user's hand;

said magazine release member being selectively positioned within said magazine release receptacle locating said magazine release button on said left side for firearm use by a right-handed user and locating said magazine release button on said left side for use by a left-handed user;

said magazine release receptacle being defined by a magazine release passage extending through said firearm frame and having substantially cylindrical passage sections and being in communication with said cartridge magazine chamber, said magazine release passage being defined in part by external non-circular outwardly facing receptacles;

said magazine release member having an intermediate portion movably received by said substantially cylindrical passage sections and having a non-circular head at a first end thereof being selectively disposed within a selected one of said external non-circular outwardly facing receptacles; and end thereof and being exposed externally of said firearm frame for magazine releasing engagement by the thumb of the user's hand;

said magazine release member being selectively reversible within said magazine release passage, positioning said magazine release button on a selected side of said firearm frame and adapting said firearm for selective use by right-handed users or left-handed users;

said magazine release member defining a substantially cylindrical end;

said magazine release button having a substantially cylindrical pocket receiving said substantially cylindrical end of said magazine release member therein; and a retainer member securing said magazine release button in removable relation with said magazine release member.

8. The firearm of claim 7, comprising:

a magazine release button removably mounted to an end of said magazine release member and being removed from said end to permit selective insertion of said magazine release member into said magazine release receptacle from said right side of said firearm frame and from said left side of said firearm frame.

* * * * *